US010443904B2

(12) United States Patent
Tatom

(10) Patent No.: US 10,443,904 B2
(45) Date of Patent: Oct. 15, 2019

(54) DEVICE FOR COOLING SUBSTANCES

(71) Applicant: Patrick Alan Tatom, Conroe, TX (US)

(72) Inventor: Patrick Alan Tatom, Conroe, TX (US)

( * ) Notice: Subject to any disclaimer, the term of this patent is extended or adjusted under 35 U.S.C. 154(b) by 187 days.

(21) Appl. No.: 15/331,897

(22) Filed: Oct. 23, 2016

(65) Prior Publication Data

US 2017/0115038 A1 Apr. 27, 2017

Related U.S. Application Data

(60) Provisional application No. 62/245,746, filed on Oct. 23, 2015.

(51) Int. Cl.

| | |
|---|---|
| ***F25B 19/00*** | (2006.01) |
| ***F25D 23/12*** | (2006.01) |
| ***F25D 25/00*** | (2006.01) |
| ***F25B 19/04*** | (2006.01) |
| ***F25D 3/10*** | (2006.01) |
| ***F25D 7/00*** | (2006.01) |

(52) U.S. Cl.

CPC ..... *F25B 19/005* (2013.01); *F25B 19/04* (2013.01); *F25D 23/12* (2013.01); *F25D 25/005* (2013.01); *F25D 3/107* (2013.01); *F25D 7/00* (2013.01)

(58) Field of Classification Search

CPC ..... F25D 23/12; F25D 19/005; F25D 25/005
See application file for complete search history.

(56) References Cited

U.S. PATENT DOCUMENTS 2,749,715 A * 6/1956 Tice ..... F25D 7/00 134/44
3,483,711 A * 12/1969 Malczewski ..... B64D 13/08 236/44 R
3,665,728 A * 5/1972 Stoller ..... F25C 1/04 62/320
3,782,602 A * 1/1974 Page ..... B65D 21/0219 222/143

(Continued)

FOREIGN PATENT DOCUMENTS

EP 2063203 A2 5/2009

OTHER PUBLICATIONS

Appl. No. PCT/US16/58355 Written Opinion of the International Searching Authority dated Feb. 16, 2017.

*Primary Examiner* — Ljiljana V. Ciric
(74) *Attorney, Agent, or Firm* — Adamsip, LLC; J. Hunter Adams; Stephen Thompson

(57) ABSTRACT

A device for cooling a substance stored within the device has a body with an internal compartment for holding the substance to be cooled. The compartment can be sealed closed and can be accessed for adding substance to the compartment for cooling or for removing substance from the compartment after cooling the substance. The body of the device has an internal cavity that surrounds the exterior of the compartment holding the substance to be cooled. Fluidized coolant is injected into the cavity through an injection port to cool the substance contained within the compartment before removing the substance from the compartment for use. The device may include exterior buttons that compress the internal compartment when the buttons are pressed toward each other, which in turn compresses and breaks up the substance contained within the compartment.

14 Claims, 7 Drawing Sheets

(56) References Cited

U.S. PATENT DOCUMENTS 4,248,298 A * 2/1981 Lamers ..... E21B 36/003 138/111
4,322,954 A 4/1982 Sheehan
4,766,740 A * 8/1988 Bradley ..... A01N 1/02 62/384
5,331,817 A * 7/1994 Anthony ..... A47J 36/28 62/293
5,434,045 A * 7/1995 Jost ..... A01N 1/02 220/4.01
5,555,741 A * 9/1996 Oakley ..... F25D 3/107 222/5
5,606,866 A * 3/1997 Anthony ..... F25D 3/107 62/294
5,704,222 A * 1/1998 Hage ..... F25D 3/107 62/293
5,836,169 A * 11/1998 Marlette ..... A47J 31/007 62/331
5,865,036 A * 2/1999 Anthony ..... F25D 3/107 62/293
5,943,875 A * 8/1999 Hymes ..... F25D 3/107 62/294
5,946,930 A * 9/1999 Anthony ..... B82Y 30/00 62/293
6,065,300 A * 5/2000 Anthony ..... F25D 3/107 220/670
6,167,718 B1 * 1/2001 Halimi ..... F25D 3/107 126/263.04
6,339,931 B1 * 1/2002 Cull ..... F25D 3/107 62/77
6,581,401 B1 * 6/2003 Anthony ..... F25D 3/107 62/293
6,673,594 B1 * 1/2004 Owen ..... A01N 1/02 435/284.1
6,715,309 B1 * 4/2004 Junkins ..... A42B 3/285 62/259.3
7,293,427 B1 11/2007 Cushnie
7,678,563 B2 * 3/2010 Wright ..... A01N 1/02 435/1.1
7,824,848 B2 * 11/2010 Owen ..... A01N 1/02 435/1.2
8,297,070 B2 * 10/2012 Pryor ..... F25D 3/14 62/259.3
8,785,116 B2 * 7/2014 Anderson ..... G01N 33/483 435/1.2
8,828,710 B2 * 9/2014 Anderson ..... A01N 1/0247 435/284.1
8,835,158 B2 * 9/2014 Judson ..... A01N 1/0247 435/1.1
9,253,976 B2 * 2/2016 Anderson ..... A01N 1/0247
9,426,979 B2 * 8/2016 Anderson ..... A01N 1/0247
9,560,846 B2 * 2/2017 Anderson ..... A01N 1/0247
9,867,368 B2 * 1/2018 Anderson ..... C12M 45/22
2003/0152673 A1 * 8/2003 Tarlow ..... B65D 81/18 426/118
2004/0082057 A1 * 4/2004 Alford ..... A01N 1/02 435/284.1
2006/0130491 A1 * 6/2006 Park ..... A47J 36/2433 62/3.6
2007/0044503 A1 * 3/2007 McCarrell ..... F24F 5/0017 62/420
2010/0050684 A1 * 3/2010 Vickroy ..... F25D 7/00 62/457.3
2010/0089913 A1 * 4/2010 Dexter ..... F01P 11/029 220/4.12
2012/0285180 A1 11/2012 Wilkenson
2012/0312031 A1 12/2012 Olson
2016/0243509 A1 * 8/2016 Kang ..... B01F 3/04808
2016/0309940 A1 * 10/2016 Valance ..... A47J 27/04
2018/0153189 A1 * 6/2018 Newman ..... F25D 13/067
2018/0328641 A1 * 11/2018 Lee ..... F25D 17/04
2019/0086143 A1 * 3/2019 Liss ..... F25D 23/12

* cited by examiner

DEVICE FOR COOLING SUBSTANCES

CROSS REFERENCES

This application claims the benefit of U.S. Provisional Application No. 62/245,746, filed on Oct. 23, 2015, which application is incorporated herein by reference.

FIELD OF THE INVENTION

The present invention refers generally to a device for cooling a quantity of a substance contained within the device.

BACKGROUND

*Cannabis*, commonly known as marijuana, is a genus of flowering plant that includes three species. Throughout human history, *cannabis* has been commonly used for medicinal purposes as well as social and recreational purposes. *Cannabis* is a common and popular recreational drug worldwide that has psychoactive effects in which the user typically enters a state of relaxation and sometimes a state of euphoria. *Cannabis* can also be used to treat a variety of medical conditions. For instance, *cannabis* is used to treat chronic pain resulting from a variety of conditions and to treat nausea and vomiting resulting from chemotherapy, among other conditions. Although the United States Federal Government classifies *cannabis* as a Schedule I drug under the U.S. Controlled Substances Act and considers *cannabis* to have "no accepted medical use," many U.S. states recognize medical uses for *cannabis* and have legalized the authorized use of *cannabis* for medical reasons. Additionally, as of the time of writing of this application, at least four U.S. states, Colorado, Washington, Oregon, and Alaska, have legalized *cannabis* for recreational use. Other states are currently considering similar laws.

*Cannabis* is commonly administered by inhaling smoke produced by burning the leaves and/or flowers of the plant in cigarettes or in various types of pipes or bongs. However, in recent years the drug has become available in various forms designed for administering the drug in ways other than smoking. One such form is a concentrated extract produced from plant material and commonly referred to as "marijuana wax" or simply "wax." Wax is a concentrate produced by extracting active compounds from marijuana using a solvent such as butane. Wax produced by butane extraction is generally referred to as butane hash oil (BHO) and comes in a variety of forms depending on the specific method of extraction and finishing processes. Marijuana wax, regardless of the specific method of extraction, generally comprises high amounts of terpenes and cannabinoids, such as tetrahydrocannabinol (THC) and cannabidiol (CBD), among other compounds.

Depending on the composition of the wax and the method of production, the texture and consistency of marijuana wax may vary considerably. In various forms typically available to consumers, the consistency ranges from a semi-solid, highly viscous oil to a sticky, frangible solid. Though the consistency may vary, marijuana wax generally has a tendency to stick to surfaces at typical ambient temperatures. The warmer the temperature of the wax, the more the wax tends to liquefy and to stick to surfaces. Due to the sticky nature of marijuana wax, many users store wax in silicone containers such as small silicone jars. Silicone containers have non-stick surfaces that the wax does not stick to easily. However, once removed from a storage container, the user needs to handle the wax to transfer the material from the storage container to a bong, vaporizer, or similar device for use. Even at typical room temperatures in the range of 70 to 80 degrees Fahrenheit, marijuana wax is typically sticky. As a result, handling the wax often results in wax sticking to a user's fingers or to any type of tool the user may use to handle the wax. Thus, handling wax is often a messy and inconvenient process.

Accordingly, a need exists in the art for a device and a method for providing marijuana wax or similar sticky substances to a user in such a way that prevents the wax from sticking to the user's hands or other surfaces during handling.

SUMMARY

In one aspect, a device that can be used for cooling a quantity of a substance is provided. In a preferred embodiment, the device is used to cool sticky substances, which may range from semi-solid oils to soft, frangible solid substances, in order to reduce the stickiness of the substance so that the substance may be handled more easily. For instance, the device may be used for cooling relatively small quantities of concentrated *cannabis* extract, referred to herein as "wax" or "marijuana wax," for personal use. The device may be used to dispense cooled wax for immediate use and also to store wax for later use. The wax is cooled to a temperature at which the wax begins to solidify, thereby making the wax less sticky and thus easier to handle. Once cooled, the wax may be transferred from the device to a bong, vaporizer, or similar device for use without sticking to the user's fingers or other surfaces during handling. Preferably, the device is relatively small in size such that the device is portable. In one embodiment, the device is small enough to fit in a pocket in a user's shirt or pants or in a small bag.

In one aspect, the device comprises a body that has an internal compartment for holding the substance to be cooled. The body also has an internal cavity that at least partially surrounds the internal compartment. The device is configured such that the internal compartment can be accessed for adding a substance to the compartment for cooling the substance or for removing the substance from the compartment. Once an amount of substance has been added to the compartment for cooling the substance, the compartment can be sealed closed so that the substance is sealed within the compartment. The body further comprises an injection port configured such that a fluid can be injected into the cavity from outside the body via the injection port in order to cool the substance contained within the compartment. The injected fluid is a coolant that surrounds the internal compartment as it is injected into the cavity. The coolant causes heat to be transferred from the compartment to the coolant, thereby causing the substance contained within the compartment to be cooled. Once cooled, the compartment can be unsealed and the cooled contents removed for immediate use.

In a preferred embodiment, the body of the device comprises an upper housing and a lower housing. The two housings are configured such that they can be attached to each other to form a continuous body and can be detached from each other. The compartment for holding the substance to be cooled is disposed within the lower housing. The upper and lower housings are configured such that when the housings are attached to each other, the compartment is sealed closed such that the contents of the compartment are isolated from the rest of the device. When the upper and lower housings are detached from each other, the compartment is accessible so that a user can add a substance to or remove a substance from the compartment.

In this embodiment, each of the two housings preferably has a cavity disposed within each respective housing. Each of the two cavities at least partially surrounds the compartment when the housings are attached to each other. The two cavities are in fluid communication with each other so as to form a single continuous voided space that extends into both housings when the housings are attached. The cavities are connected to one another via passageways in each respective housing that align with each other when the housings are attached so as to form a passageway connecting the two cavities. Thus, when coolant is injected into one of the cavities, the fluid flows into both cavities. This configuration provides greater surface area for the fluid to contact exterior surfaces of the compartment and thus to more efficiently cool the substance contained within the compartment.

The foregoing summary has outlined some features of the device of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the device disclosed herein. Those skilled in the pertinent art should also realize that such equivalent designs or modifications do not depart from the scope of the device of the present disclosure.

DESCRIPTION OF THE DRAWINGS

These and other features, aspects, and advantages of the present invention will become better understood with regard to the following description, appended claims, and accompanying drawings where:

DETAILED DESCRIPTION

Figure 1:
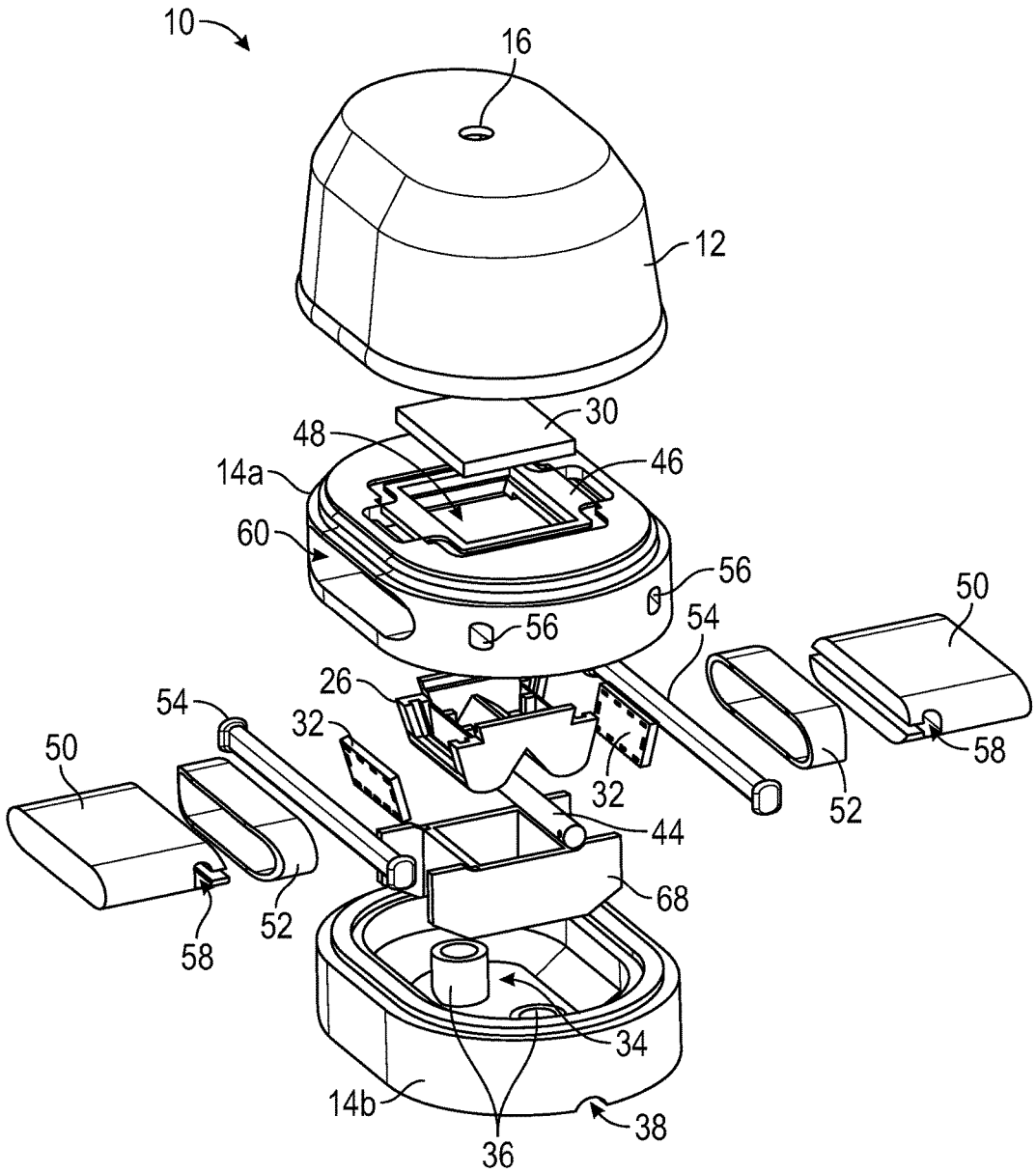
FIG. 1 shows an exploded view of a device in accordance with the present disclosure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

In one aspect, a device 10 that can be used for cooling a quantity of a substance is provided. In a preferred embodiment, the device 10 is used to cool sticky substances, which may range from semi-solid oils to soft, frangible solid substances, in order to reduce the stickiness of the substance so that the substance may be handled more easily. For instance, the device 10 may be used for cooling relatively small quantities of concentrated *cannabis* extract, referred to herein as "wax" or "marijuana wax," for personal use. The device 10 may be used to dispense cooled wax for immediate use and also to store wax for later use. The wax is cooled to a temperature at which the wax begins to solidify, thereby making the wax less sticky and thus easier to handle. Once cooled, the wax may be transferred from the device to a bong, vaporizer, or similar device for use without sticking to the user's fingers or other surfaces during handling. Preferably, the device 10 is relatively small in size such that the device is portable. In one embodiment, the device is small enough to fit in a pocket in a user's shirt or pants or in a small bag.

The consistency of marijuana wax typically ranges from a semi-solid, highly viscous oil to a soft, frangible solid depending on the quality of the wax and the process of producing the wax. In any of these forms, the wax is usually quite sticky and thus generally difficult to handle due to its stickiness at typical room temperatures in the range of 70 to 80 degrees Fahrenheit. In a preferred embodiment, the device 10 is generally used for temporarily cooling wax to reduce the stickiness of the wax during handling. However, it should be understood that the device 10 may also be used to cool quantities of other substances, or to store other substances for later use. For instance, in one embodiment, the device may be used to cool or to store vials of insulin.

In one aspect, the device 10 comprises a body having a compartment 26 disposed therein. The body is configured such that the compartment 26 can be sealed closed during periods of use, and the compartment 26 can be accessed for adding a substance to or removing a substance from the compartment 26 during periods of non-use. As used herein, a "period of use" refers to a period in which the device 10 is being used to cool a substance contained therein. The body of the device 10 has a cavity 34 disposed therein. The cavity 34 at least partially surrounds the compartment 26. The body of the device 10 has an injection port 16 configured such that a fluid can be injected into the cavity 34 from outside the body via the injection port 16. Thus, a fluidized coolant can be injected into the cavity 34 surrounding the exterior of the compartment 26 containing the substance to be cooled. During use, the compartment 26 is sealed so that the coolant does not come into contact with the substance contained within the compartment 26. The coolant injected into the cavity 34 causes heat to be transferred from the compartment 26 so that the substance is cooled.

Figure 2:
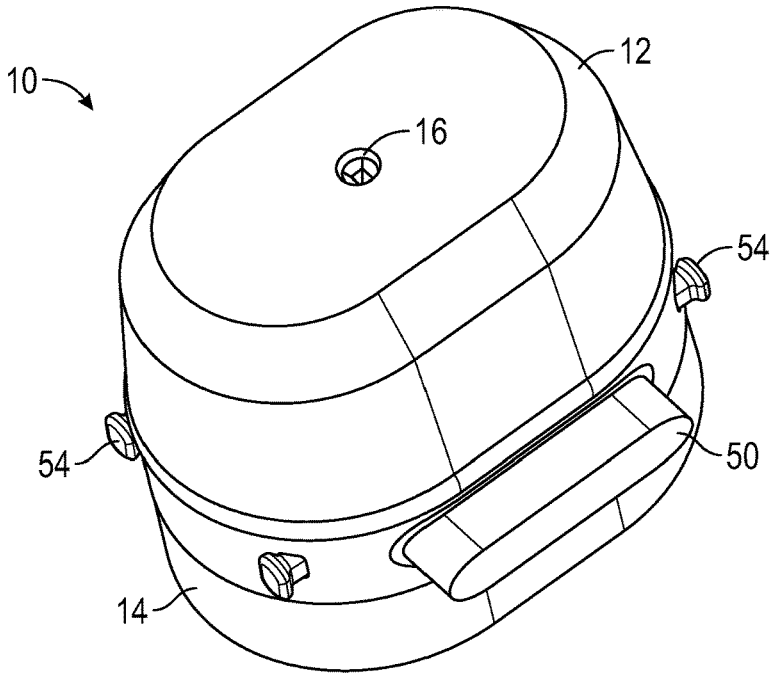
FIG. 2 shows a top perspective view of a device in accordance with the present disclosure.
Figure 3:
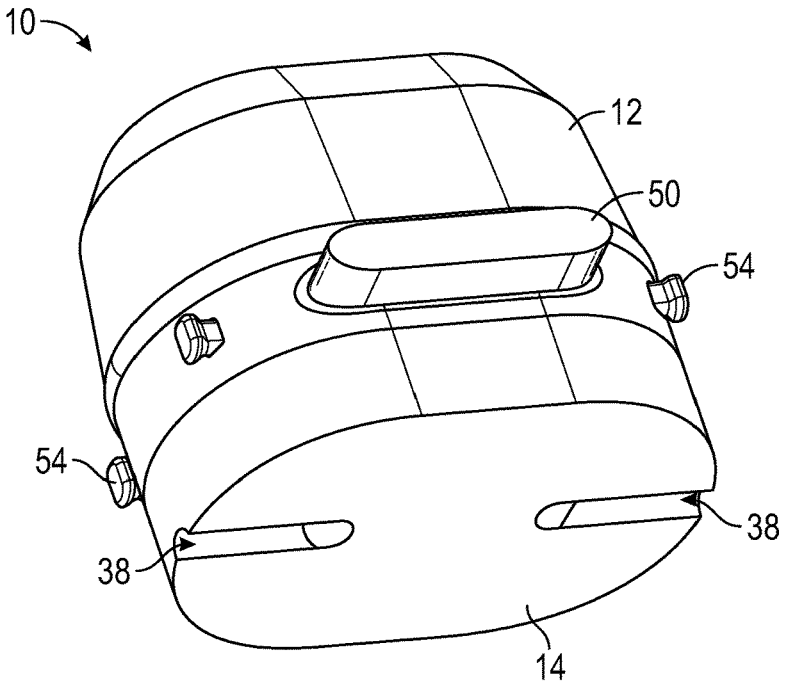
FIG. 3 shows a bottom perspective view of a device in accordance with the present disclosure.
Figure 6:
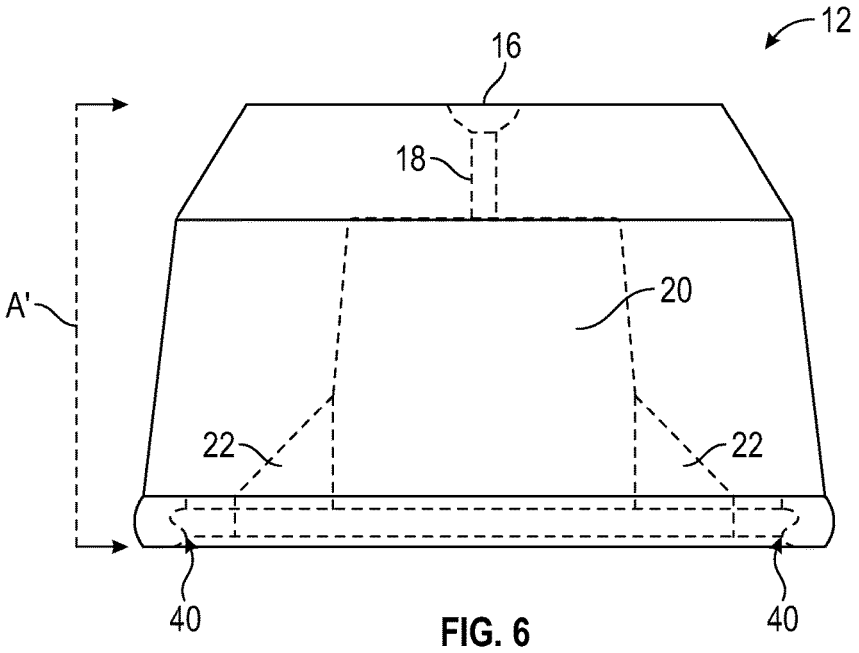
FIG. 6 shows a front elevational view of a component of a device in accordance with the present disclosure.
Figure 7:
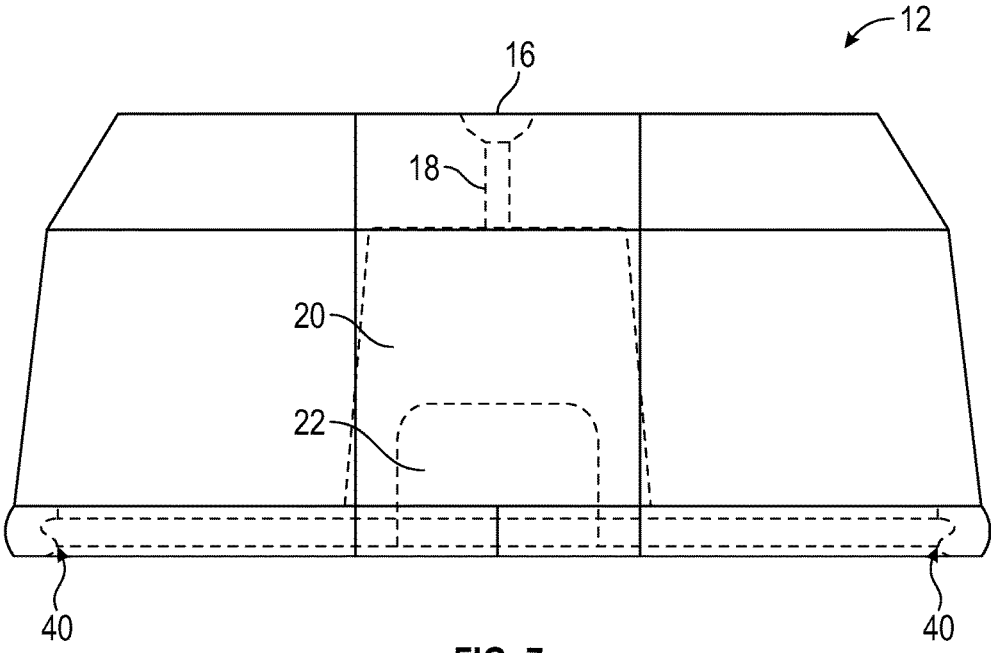
FIG. 7 shows a side elevational view of a component of a device in accordance with the present disclosure, as seen along line A'.
Figure 8:
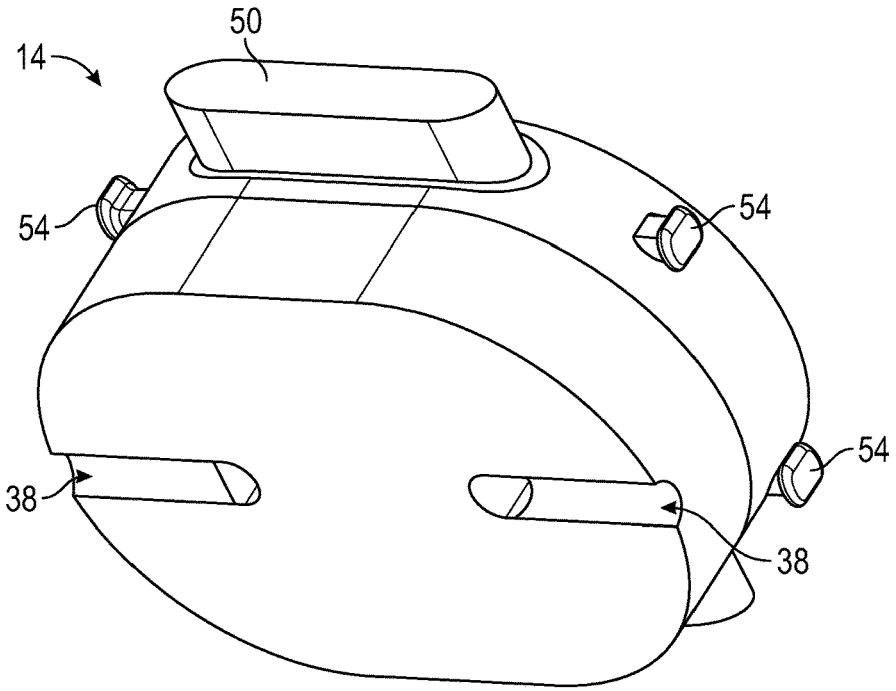
FIG. 8 shows a bottom perspective view of a component of a device in accordance with the present disclosure.
Figure 9:
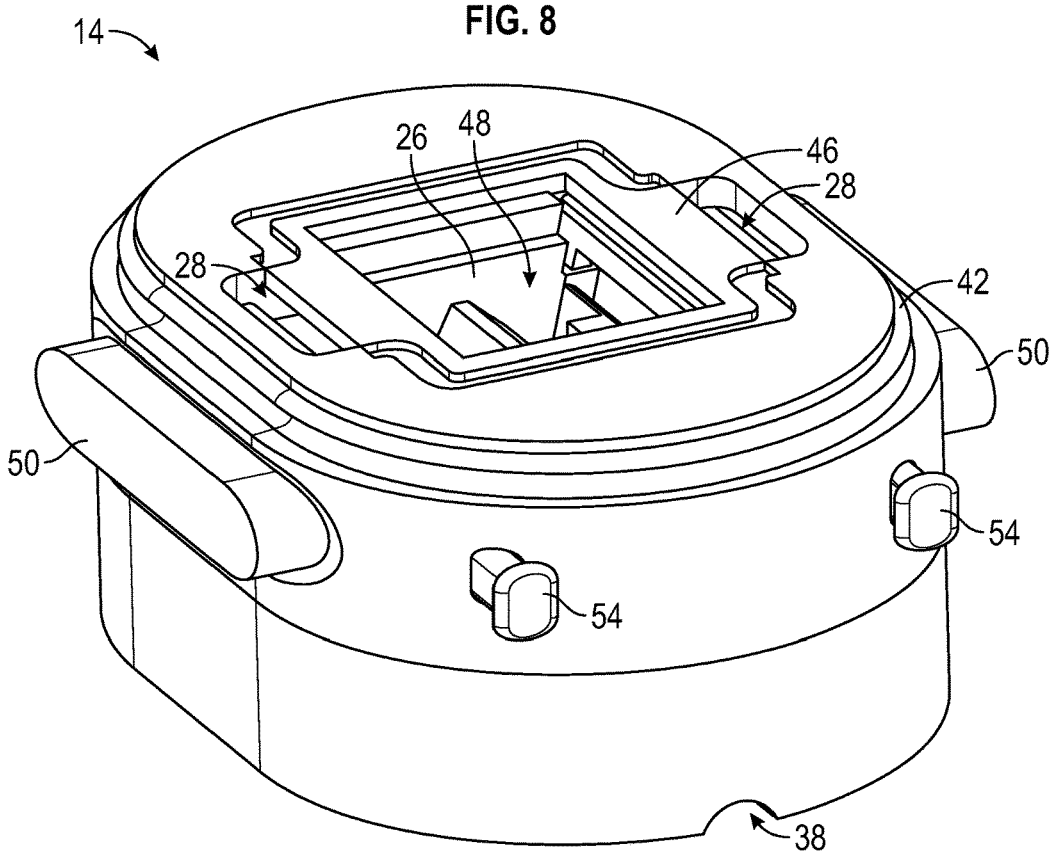
FIG. 9 shows a top perspective view of a component of a device in accordance with the present disclosure.

FIGS. 1-3 illustrate a preferred embodiment of the device. In a preferred embodiment, the body of the device comprises an upper housing 12 and a lower housing 14. The two housings 12 and 14 are configured such that they can be attached to each other to form a continuous body and can be detached from each other. FIGS. 2 and 3 illustrate the device 10 with the upper housing 12 attached to the lower housing 14. FIGS. 4-7 illustrate a detached upper housing 12, and FIGS. 8-9 illustrate a detached lower housing 14. As shown in FIG. 1, the lower housing 14 may comprise an upper portion 14*a* and a lower portion 14*b* that are permanently attached to each other to form the lower housing 14 during the manufacturing of the device 10.

Figure 11:
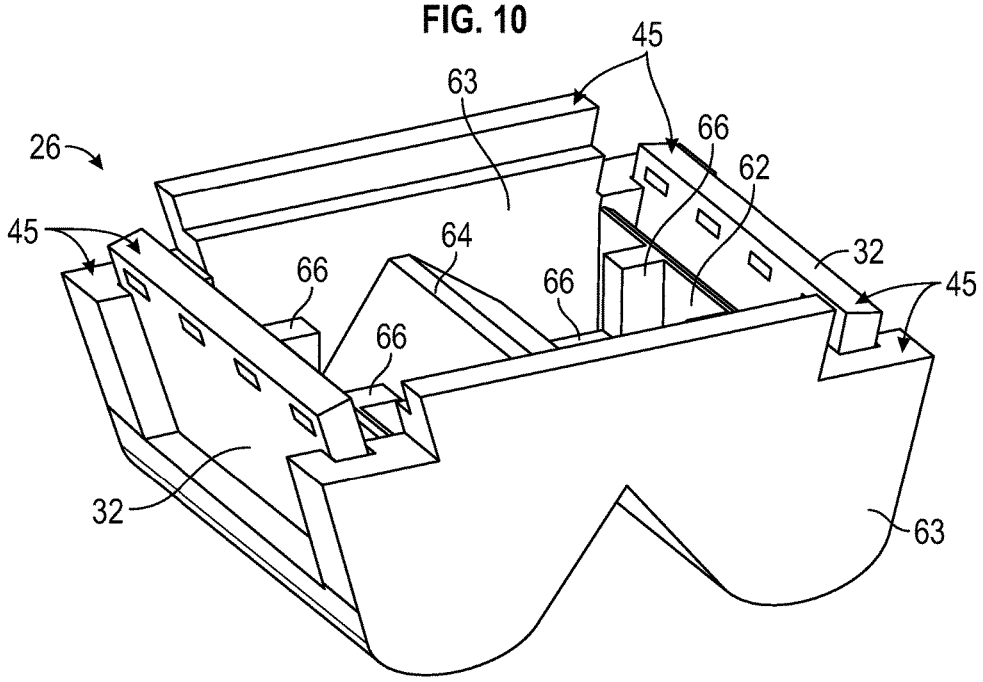
FIG. 11 shows a perspective view of a component of a device in accordance with the present disclosure.
Figure 12:
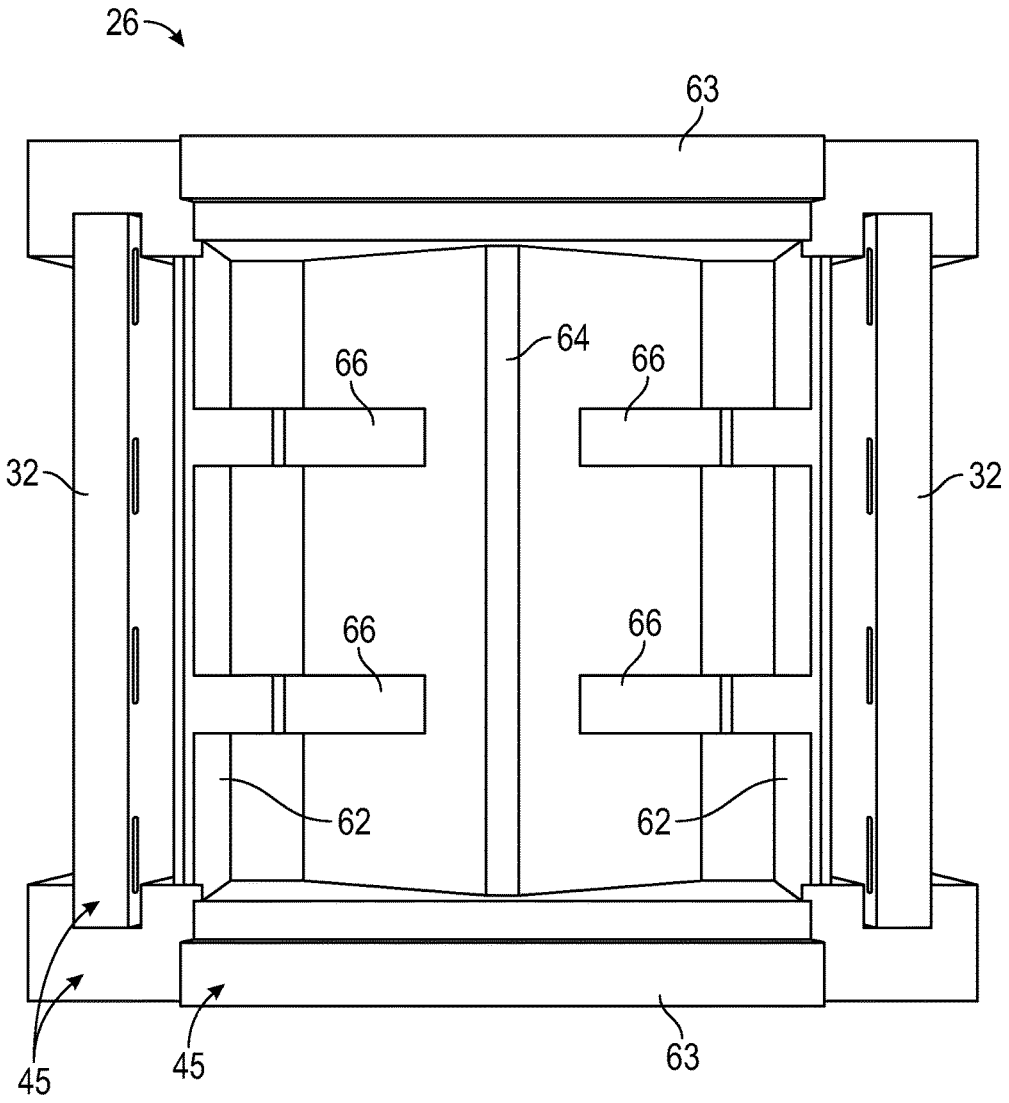
FIG. 12 shows a top plan view of a component of a device in accordance with the present disclosure.

In a preferred embodiment, as best seen in FIG. 9, the compartment 26 is disposed within the lower housing 14. FIGS. 11-12 show an illustrative compartment 26 that may be used in manufacturing the device 10. The compartment 26 is a container for holding the substance to be cooled by the device 10. The upper housing 12 and lower housing 14 are configured such that when the housings are attached to each other, as shown in FIGS. 2 and 3, the compartment 26 is sealed closed such that the contents of the compartment 26 are isolated from the rest of the device 10. When the upper housing 12 is detached from the lower housing 14, the compartment 26 is accessible so that a user can add a substance to or remove a substance from the compartment 26.

As used herein, the upper housing 12 is "attached" to the lower housing 14 when the upper housing 12 is removably secured to the lower housing 14 by any suitable means. In a preferred embodiment, as can be seen in FIGS. 4-7 and in FIG. 9, the upper housing 12 has a lip 40 and groove around the perimeter of the housing 12, and the lower housing 14 has a corresponding lip 42 and groove around the perimeter of the housing 14. The lips 40 and 42 of each respective housing 12 and 14 are configured such that the upper housing 12 can be positioned over the lower housing 14 and snapped onto the lower housing 14 by applying a downward force to the upper housing 12. When the housings are snapped together, the lip 40 of the upper housing 12 fits into the groove in the lower housing 14, and the lip 42 of the lower housing 14 fits into the groove in the upper housing 12. The lips 40 and 42 are configured such that the upper housing 12 can be detached from the lower housing 14 by pulling the housings apart. It should be understood that any suitable means for attaching and detaching the upper and lower housings 12 and 14 may be utilized, including, but not limited to a hinge, latch, buckle, snap fasteners, magnets, or other similar types of fastening mechanisms known in the art.

In a preferred embodiment, the body of the device 10 is at least partially made of an elastic material such that the body can be squeezed and return to its original shape.

As shown in FIG. 1, the upper portion 14*a* of the lower housing 14 has a central opening 48 through which the top of the compartment 26 can be accessed for adding a substance to or removing a substance from the compartment 26. FIG. 9 illustrates an assembled lower housing 14 with the compartment 26 permanently bonded to the lower housing 14. As shown in FIG. 9, the compartment 26 is accessible through the central opening 48 when the upper housing 12 is detached.

The lower housing 14 has a cavity 34 disposed within the lower housing 14, and the cavity 34 at least partially surrounds the compartment 26. FIG. 11 illustrates an example compartment 26 that may be utilized in manufacturing the device 10, as discussed in detail below. As shown in FIG. 11, the compartment 26 is defined by walls 32 and 63, which have upper surfaces 45. In a preferred embodiment, the upper surfaces 45 of the compartment 26 are permanently bonded to the upper portion 14*a* of the lower housing 14 by an injection molding procedure and, optionally, an additional adhesive. Thus, when the lower housing 14 is assembled, as shown in FIG. 9, a cavity 34 is formed within the lower housing 14 surrounding the exterior of the compartment 26. The cavity 34 is defined by inner surfaces of the assembled lower housing 14 and the exterior of the compartment 26, as can be seen in FIG. 1. The method of bonding the compartment 26 to the lower housing 14 forms an airtight seal between the interior of the compartment 26 and the cavity 34 surrounding the exterior of the compartment 26.

As shown in FIG. 2, the body of the device 10 has an injection port 16 on the exterior of the body. The injection port 16 is configured such that a fluid, such as a fluidized coolant, can be injected into the cavity 34 from outside the body via the injection port 16.

Figure 4:
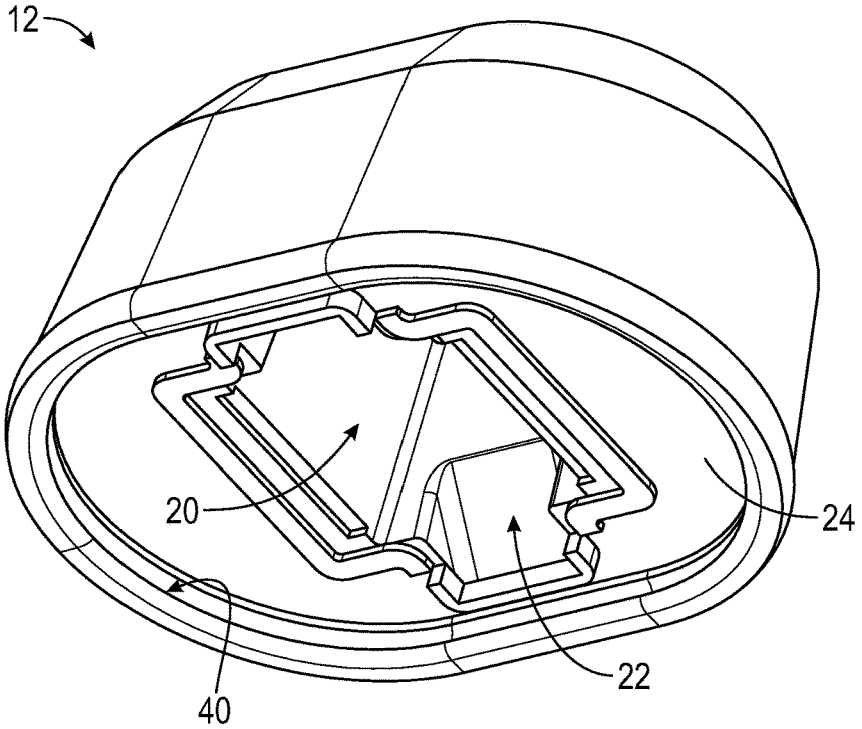
FIG. 4 shows a perspective view of a component of a device in accordance with the present disclosure.
Figure 5:
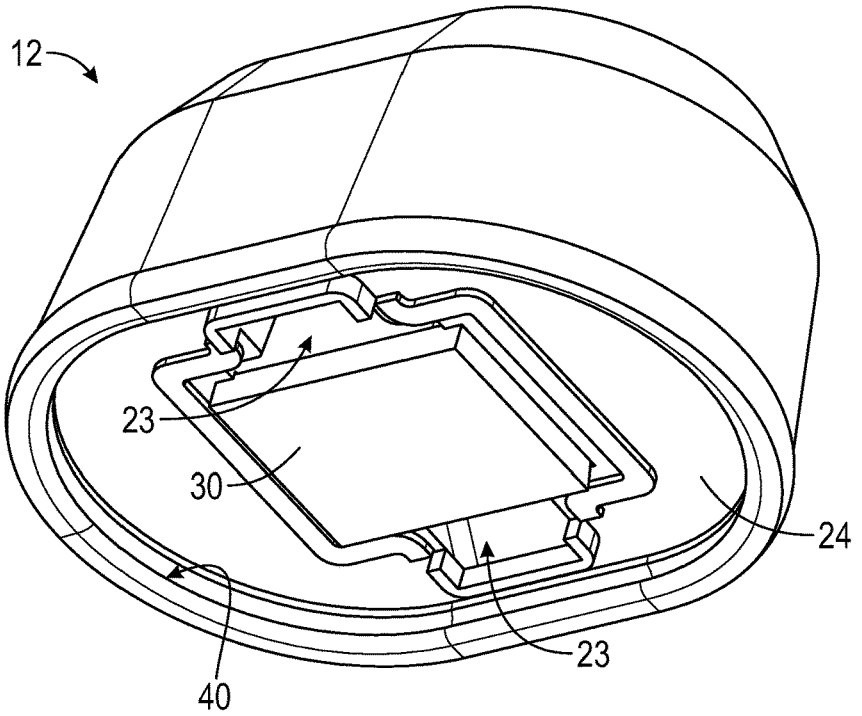
FIG. 5 shows a perspective view of a component of a device in accordance with the present disclosure.

In a preferred embodiment, the upper housing 12 additionally has a cavity 20 disposed within the upper housing 12. FIGS. 6 and 7 show a front view and a side view of the upper housing 12, respectively, with dashed lines indicating the internal location of the cavity 20 and two passageways 22 located on opposing sides of the cavity. Each passageway 22 leads to an opening 23 in the bottom of the upper housing 12. As shown in FIG. 5, the upper housing 12 has a plate 30 installed on the bottom side of the housing 12. The top side of the plate 30 is adjacent to the cavity 20 in the upper housing 12. FIG. 4 shows the upper housing 12 without the plate 30 installed thereon for the purpose of illustrating the cavity 20 and passageways 22. With the plate 30 installed, as shown in FIG. 5, the openings 23 are located on opposing sides of the plate 30. When the upper housing 12 is attached to the lower housing 14, the plate 30 covers the central opening 48 of the lower housing 14 and seals the top of the compartment 26 closed. The lower housing 14 preferably comprises a gasket 46 located around the central opening 48. The gasket 46 fits around the plate 30 to ensure that the compartment 26 is sealed tightly so that the interior space of the compartment will not be in fluid communication with any other portion of the device, including the cavity 20 in the upper housing 12, the cavity 34 in the lower housing 14, or the two passageways 22, when the upper housing 12 is attached to the lower housing 14.

FIG. 9 illustrates an assembled lower housing 14. As shown in FIG. 9, the lower housing 14 has two openings 28 on opposite sides of the central opening 48 that provides access to the interior of the compartment 26. The openings 28 lead to the cavity 34 surrounding the exterior of the compartment 26 in the lower housing 14. The two passageways 22 are configured such that each opening 23 in the upper housing 12 aligns with a corresponding opening 28 in the lower housing 14 when the upper housing 12 is attached to the lower housing 14. Thus, when the housings are attached, the cavity 34 in the lower housing 14 is in fluid communication with the cavity 20 in the upper housing 12 via the passageways 22. The two cavities 20 and 34 and the passageways 22 form a single continuous voided space through which fluid can flow when the housings 12 and 14 are attached. In a preferred embodiment, as shown in FIG. 5, each opening 23 has an extension extending downward from a bottom surface 24 of the upper housing 12. The extensions are configured such that the extensions are inserted into the openings 28 in the lower housing 14 when attaching the upper housing 12. The extensions ensure that the openings 23 and 28 are aligned when the housings are attached.

In a preferred embodiment, the injection port 16 is configured such that fluid can be injected directly into the cavity 20 in the upper housing 12, as shown in FIGS. 6-7. A tube 18 provides a conduit between the injection port 16 and the cavity 20 in the upper housing 12. Injected fluid may then flow into the injection port 16, through the tube 18, into the cavity 20 in the upper housing 12, through each of the passageways 22, and into the cavity 34 in the lower housing 14. Fluid located in these voided spaces will not come into contact with the contents of the compartment 26 when the housings 12 and 14 are attached to each other. As shown in FIG. 3, the lower housing 14 preferably has at least one exit opening 38, which allows fluid in the cavity 34 in the lower housing 14 to exit the lower housing 14. In a preferred embodiment, also shown in FIG. 3, the lower housing 14 has a flat bottom so that the device 10 will stand in an upright position when resting on a flat surface. Each exit opening 38 preferably has a groove extending to the edge of the lower housing 14, as shown in FIG. 3, so that fluid may exit the lower housing 14 when the device 10 is standing in an upright position on a flat surface.

To use the device 10 for cooling a substance, such as wax, the upper housing 12 is detached from the lower housing 14, and a quantity of the substance is added into the top of the compartment 26 of the lower housing 14 through opening 48. The upper housing 12 is then attached to the lower housing 14 such that the substance is sealed within the interior of the compartment 26. A fluidized coolant is then injected into the injection port 16 of the upper housing 12. As the coolant is injected, it flows through the tube 18, into the cavity 20 in the upper housing 12, through each of the passageways 22, and then into the cavity 34 in the lower housing 14. Cavities 20 and 34 each partially surround the sealed compartment 26. In a preferred embodiment, the compartment 26 has sidewalls 32 made of a metallic material that effectively conducts heat. In addition, the plate 30 that seals the top of the compartment 26 closed is preferably made of a metallic material for conducting heat. Each of the sidewalls 32 and plate 30 have one side that faces the interior of the sealed compartment 26 and one side that faces one of cavities 34 and 20, respectively. Thus, the coolant injected into cavities 20 and 34 comes into direct contact with each of the sidewalls 32 and the plate 30, which function as heat transfer elements. When coolant is injected, heat is effectively transferred from the interior of the compartment 26 to the coolant exterior to the compartment 26, thereby cooling the substance contained in the compartment 26. When using the device 10 to cool a sticky substance such as wax, the wax is sufficiently cooled to substantially reduce the stickiness of the wax and to solidify any semi-solid or liquefied wax.

The coolant is preferably a compressed gas having a low boiling point such that the coolant evaporates quickly as it is injected into the device 10. In a preferred embodiment, the coolant is 1,1,1,2-tetrafluoroethane or any similar commercially available refrigerant. In another embodiment, the coolant may be liquid nitrogen. Such refrigerants are typically available in cans of compressed liquid that evaporate rapidly, thereby causing the refrigerant to be expelled from the can as a high pressure stream of gas. In other embodiments, the can of refrigerant has a dip tube such that the refrigerant is sprayed as a liquid that evaporates rapidly after being sprayed. Such liquid refrigerants are commonly referred to as "freeze spray" and are commercially available from a number of manufacturers. Cans of freeze spray typically have a nozzle for spraying the liquid coolant, and the injection port 16 of the device is preferably sized such that a nozzle can be inserted into the injection port 16 for injecting the coolant into cavities 20 and 34 of the device 10. As the coolant is sprayed into the device, it rapidly fills the interior voided space of the device and begins to evaporate. The evaporated coolant then escapes from the device 10 through the exit openings 38 in the lower housing 14, as well as back through the injection port 16 opening in the upper housing 12. The effect of evaporative cooling causes heat to be transferred from the interior of the compartment 26 to the coolant, thereby cooling the contents of the compartment 26. Using freeze spray, the cooling process typically takes only a few seconds. After cooling the contents, the upper housing 12 can be removed to access the substance contained in the compartment 26. When removing cooled wax from the compartment 26, the wax can be handled without sticking to the user's fingers or other surfaces, such as the surface of any tool used in transferring the wax out the compartment 26.

In a preferred embodiment, as seen in FIG. 1, the lower housing 14 preferably comprises at least one exit tube 36 disposed within the cavity 34 of the lower housing 14 and extending upward from the bottom of the lower housing 14. The exit tubes 36 lead to the exit openings 38 from which coolant may exit the lower housing 14 as it evaporates. The upwardly extending exit tubes 36 prevent any coolant in liquid form from leaking from the lower housing 14 before evaporating.

Figure 10:
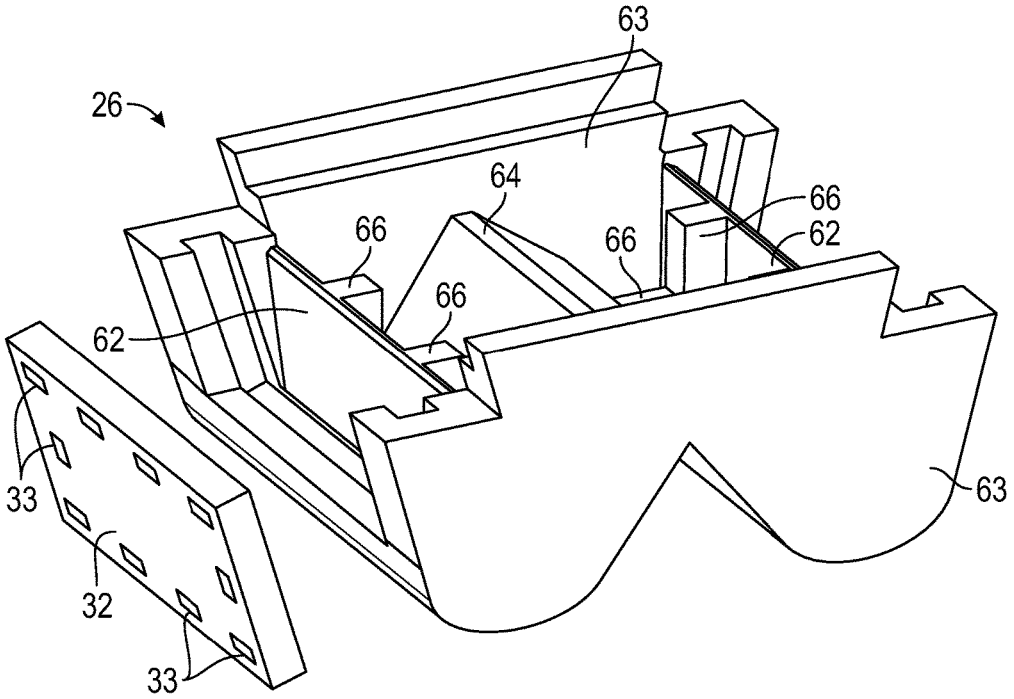
FIG. 10 shows a perspective view of a component of a device in accordance with the present disclosure.

FIGS. 11-12 show an illustrative compartment 26 that may be used in manufacturing the device 10. In a preferred embodiment, the compartment 26 has sidewalls 32 made of a metallic material for conducting heat. FIG. 10 shows an illustrative compartment 26 without the sidewalls 32 for purposes of illustration. The remainder of the compartment 26, including front and rear walls 63, are preferably made of an elastic material that can be compressed and then return to its original shape. In a preferred embodiment, the remainder of the compartment 26 is made of platinum-cured silicone rubber, another type of silicone rubber, or similar material that is elastic and has non-stick properties. Non-stick surfaces prevent sticky substances such as wax from sticking to the interior surfaces of the compartment 26.

In a preferred embodiment, as best seen in FIGS. 1-3 and in FIG. 9, the lower housing 14 comprises two opposing buttons 50 disposed on opposite sides of the compartment 26. The buttons 50 are configured such that the buttons 50 compress the compartment 26 when the buttons 50 are pressed toward each other. When using the device 10 to cool a quantity of wax, the cooled wax may harden and solidify. Compressing the compartment 26 after cooling the wax may break the cool and hardened wax into smaller pieces for ease of use. Because wax is a concentrated extract, only a small quantity is typically needed for each use. In a preferred embodiment, the buttons 50 are used to compress the compartment 26 to aid in removal of the cooled wax after the upper housing 12 has been detached from the lower housing 14.

FIG. 1 illustrates a preferred configuration of the buttons 50 for compressing the compartment 26. In this embodiment, the lower housing 14 has two button slots 60 on opposite sides of the housing 14. A button sleeve 52 is fitted into each button slot 60 and permanently bonded to the lower housing 14 using an adhesive. The buttons 50 slide through the button sleeves 52 when pressing the buttons 50. The buttons 50 and button sleeves 52 are preferably made of a relatively hard and rigid material so that the buttons 50 can slide back and forth inside the button sleeves 52. The device 10 further comprises an elastic button rod 54 for each button 50. Each button rod 54 fits into a groove 58 in each button 50 for securing the button 50 to the rod 54. Each groove 58 has a lip, as seen in FIG. 1, to keep the button 50 secured to the rod 54. As seen in FIGS. 2 and 3, the ends of the button rods 54 extend through openings 56 in the lower housing 14. The rods 54 have enlarged ends to prevent the ends of the rods 54 from being pulled inside the lower housing 14 when the buttons 50 are pressed. When a user presses the buttons 50, the buttons 50 contact the sidewalls 32 of the compartment 26, thereby compressing the compartment 26 and any substance contained within the compartment 26. Pressing the buttons 50 causes the button rods 54 to bend and stretch. When the user releases the buttons 50, each of the elastic button rods 54 returns to its original, straightened shape, as shown in FIG. 1, which forces the buttons 50 to return to a resting position, as shown in FIGS. 2 and 3.

The device 10 may optionally comprise a button guide 68 disposed within the lower housing 14, as shown in FIG. 1. When the device 10 is assembled, the button guide 68 is positioned below the bottom of the compartment 26. The button guide 68 supports the buttons 50 as the buttons are pressed and prevents the buttons 50 from sliding below the compartment 26 when the buttons 50 are pressed.

The compartment 26 may optionally include a central divider 64 and subcompartment walls 66, which may be attached to internal walls 62. The divider 64 and subcompartment walls 66 form subcompartments within the compartment 26, as shown in FIG. 12. The subcompartments may facilitate breaking the substance in the compartment 26 into smaller pieces. When used for cooling wax, the wax may be a semi-solid, viscous oil that may naturally settle into the subcompartments if the wax is stored in the device 10. The wax may also be a soft, frangible solid. In either case, the subcompartments may break up the wax when the compartment 26 is compressed using the buttons 50. Once the wax is cooled, the user may then remove a desired quantity from one or more subcompartments and leave any remaining wax in the device 10 for storage so that it can be later re-cooled for later use.

As shown in FIG. 11, the central divider 64 results in an inverted V-shaped bottom of the compartment 26. In a preferred embodiment, as shown in FIG. 1, the device 10 further comprises a rod 44 disposed within the lower housing 14 and positioned under the central divider 64. Each end of the rod 44 may be attached to the inside of the lower housing 14 to keep the rod 44 in stationary position. The rod 44 is preferably made of a relatively hard, rigid material so that the rod 44 aids in breaking up the substance contained in the compartment 26 when the buttons 50 are pressed to compress the compartment 26.

As shown in FIG. 11, the internal walls 62 are low enough so that when the compartment 26 is sealed closed, air inside the compartment 26 contacts the sidewalls 32 of the compartment 26 for effective heat transfer.

As best seen in FIG. 10, the metallic sidewalls 32 of the compartment 26 preferably have a series of holes 33 extending through the sidewalls 32 around the perimeter of the sidewalls 32. The remainder of the compartment 26 is preferably made of silicone rubber or a similar elastic material that can be injection molded. To produce the compartment 26 shown in FIG. 11, an injection molding procedure may be used to mold the elastic portion of the compartment 26 and bond the elastic portion to the metallic sidewalls 32. For instance, liquid silicone rubber may be poured into a mold that includes the metallic sidewalls 32. The sidewalls 32 are positioned in the mold so that the liquid silicone rubber fills the holes 33 on three sides of the sidewall 32 and cures. After curing, the silicone rubber portion of the compartment becomes permanently bonded to the sidewalls 32 to form the molded compartment shown in FIG. 11. It should be understood that the compartment shown in FIG. 11 is an illustrative example and other shapes may be utilized when producing the compartment 26 of the device 10.

The compartment 26 including the metallic sidewalls 32 may then be permanently bonded to the lower housing 14 also using an injection molding procedure. The compartment 26 may be fitted into a mold for the upper portion **14*a* of the lower housing 14. Liquid poured into the mold may fill the exposed holes 33 along the top side of the sidewalls 32, as seen in FIG. 11. After curing, the sidewalls 32 are mounted into and permanently bonded to the upper portion 14*a* of the lower housing 14. In addition, an optional adhesive may be applied to the upper surfaces 45 of the front and rear walls 63 to bond the walls 63 to the upper portion 14*a* of the lower housing 14. This process produces an airtight seal so that the contents of the compartment 26 will not be exposed to any coolant in the cavity 34 surrounding the compartment 26** during use. The adhesive is preferably a urethane adhesive.

In preferred embodiments, various components of the device 10 may be made of the following materials of construction. The upper housing 12 may be made of a relatively hard polymer, elastomer, or rubber. For instance, the upper housing 12 may be made of urethane having a Shore hardness of 50A. The lower housing 14 may be made of urethane having a Shore hardness of 30A. The upper portion **14*a* and the lower portion 14*b* of the lower housing 14 are preferably made of the same material, though different materials may be utilized. Urethane with a Shore hardness of 30A provides an elastic lower housing 14 that may be deformed and then return to its original shape when compressing the compartment 26 using the buttons 50. The compartment 26 (excluding the sidewalls 32) may be made of platinum-cured silicon having a Shore hardness of 10A. The compartment 26** is preferably highly elastic such that it can return to its original shape after being compressed significantly.

The upper portion **14*a* and the lower portion 14*b* of the lower housing 14 may be bonded together using a urethane adhesive to form the lower housing 14 during manufacturing. The plate 30 used for sealing the compartment 26 closed may be bonded to the upper housing 12** using an epoxy adhesive with an adhesion promoter.

The buttons 50 and button sleeves 52 may be made of urethane having a high Shore hardness value, or of another hard material such as a hard plastic, which may include polypropylene or ABS plastic. The button sleeves 52 may be bonded to the lower housing 14 using a urethane adhesive. The button rods 54 may be made of platinum-cured silicone rubber having a Shore hardness of about 10A to about 20A. This material may provide button rods 54 that can stretch enough to allow the buttons 50 to be pressed sufficiently for compressing the compartment 26.

In a preferred embodiment, the sidewalls 32 of the compartment 26 and the plate 30 for sealing the compartment 26 closed are made of rhodium-plated silver, but may be made of other metals or combinations of metals, including, but not limited to, platinum-plated silver, platinum-plated copper, nickel-plated copper, silver-plated copper, gold-plated copper, silver, gold, or any metallic material effective for conducting heat. Metals plated with rhodium, platinum, silver, or nickel may be selected because wax and other sticky substances typically do not stick to these metals.

It is understood that versions of the invention may come in different forms and embodiments. Additionally, it is understood that one of skill in the art would appreciate these various forms and embodiments as falling within the scope of the invention as disclosed herein.

What is claimed is:

1. A device for cooling substances, said device comprising a body, said body comprising an upper housing and a lower housing, wherein the upper housing and the lower housing are configured such that the upper housing and the lower housing can be attached to and detached from each other, wherein the lower housing has a compartment disposed within the lower housing, said compartment being accessible when the upper housing is detached from the lower housing, and said compartment being sealed closed when the upper housing is attached to the lower housing, said lower housing having a cavity disposed within the lower housing, wherein the cavity at least partially surrounds the compartment, and wherein the body has an injection port configured such that a fluid can be injected into the cavity from outside the body via the injection port, wherein the lower housing comprises two opposing buttons disposed on opposite sides of the compartment, wherein the buttons are configured to compress the compartment when the buttons are pressed toward each other.

2. The device of claim 1, wherein the body is at least partially made of an elastic material.

3. The device of claim 1, wherein the compartment is defined by walls, and wherein a portion of the walls is made of an elastic material.

4. The device of claim 3, wherein a portion of the walls is made of a metallic material.

5. The device of claim 4, wherein at least a portion of the metallic material is adjacent to the cavity.

6. The device of claim 1, wherein the upper housing has a cavity disposed within the upper housing, and wherein the cavity in the upper housing is in fluid communication with the cavity in the lower housing when the upper housing is attached to the lower housing.

7. The device of claim 6, wherein the injection port is configured such that a fluid can be injected directly into the cavity disposed within the upper housing.

8. The device of claim 1, wherein the compartment has a central divider, and wherein the device further comprises a rigid rod positioned under the central divider.

9. A device for cooling a substance, said device comprising a body having a compartment disposed within the body, wherein the body is configured such that the compartment can be sealed closed during periods of use, and the compartment can be accessed for adding a substance to or removing a substance from the compartment during periods of non-use, wherein the body further has a cavity disposed within the body, wherein the cavity at least partially surrounds the compartment, and wherein the body has an injection port configured such that a fluid can be injected into the cavity from outside the body via the injection port, wherein the lower housing comprises two opposing buttons disposed on opposite sides of the compartment, wherein the buttons are configured to compress the compartment when the buttons are pressed toward each other.

10. The device of claim 9, wherein the body is at least partially made of an elastic material.

11. The device of claim 9, wherein the compartment is defined by walls, and wherein a portion of the walls is made of an elastic material.

12. The device of claim 11, wherein a portion of the walls is made of a metallic material.

13. The device of claim 12, wherein at least a portion of the metallic material is adjacent to the cavity.

14. The device of claim 9, wherein the compartment has a central divider, and wherein the device further comprises a rigid rod positioned under the central divider.

* * * * *